US009451351B2

(12) United States Patent
Smailagic et al.

(10) Patent No.: US 9,451,351 B2
(45) Date of Patent: Sep. 20, 2016

(54) IN-EAR HEADPHONE

(75) Inventors: Sead Smailagic, Helsingborg (SE); Martin Nyström, Hörja (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 836 days.

(21) Appl. No.: 13/161,537

(22) Filed: Jun. 16, 2011

(65) Prior Publication Data

US 2012/0321103 A1 Dec. 20, 2012

(51) Int. Cl.
*H04R 1/10* (2006.01)
*H04R 5/033* (2006.01)

(52) U.S. Cl.
CPC ..... *H04R 1/1041* (2013.01); *H04R 5/033* (2013.01); *H04R 2420/03* (2013.01)

(58) Field of Classification Search
CPC .. H04R 1/326; H04R 1/1016; H04R 1/1041; H04R 5/033; H04R 5/04; H04R 2420/03; H04R 2420/07
USPC ..... 381/98, 322, 26, 74, 370–374, 382, 384
See application file for complete search history.

(56) References Cited

U.S. PATENT DOCUMENTS 3,439,129 A * 4/1969 Knauert et al. ..... 381/322
3,702,123 A 11/1972 Macken et al.
3,999,020 A * 12/1976 Bastiaans et al. ..... 381/372
5,555,554 A * 9/1996 Hofer et al. ..... 381/371
RE37,398 E * 10/2001 Nageno ..... 381/371
6,549,635 B1 * 4/2003 Gebert ..... H04R 25/456 381/322
7,489,794 B2 * 2/2009 Harvey ..... 381/380
7,590,258 B2 * 9/2009 Krywko ..... 381/380
7,903,826 B2 3/2011 Boersma
7,916,888 B2 3/2011 Sapiejewski et al.
8,295,505 B2 * 10/2012 Weinans ..... H04R 1/1041 381/322
2001/0031054 A1 * 10/2001 Grimani ..... 381/98
2002/0146142 A1 * 10/2002 Myers ..... 381/371

(Continued)

FOREIGN PATENT DOCUMENTS

EP 2071872 A1 6/2009
WO 2009104834 A1 8/2009

OTHER PUBLICATIONS

Extended European Search Report dated Aug. 8, 2012 issued in corresponding EP application No. 12165669, 6 pages.

*Primary Examiner* — Xu Mei
(74) *Attorney, Agent, or Firm* — Tucker Ellis LLP

(57) ABSTRACT

A headphone device includes a housing having a leakage hole to reduce pressure between a user's ear and the housing, a speaker positioned within the housing, and an audio processing module. The audio processing module is configured to receive an audio signal from an audio device, determine whether the audio signal includes at least a predetermined level of audio having a frequency in a first range of frequencies, transmit a first leakage control signal to a leakage hole valve when it is determined that the audio includes at least the predetermined level of low frequency audio; and transmit a second leakage control signal to the leakage hole valve when it is determined that the audio does not include at least the predetermined level of low frequency audio. The leakage hole valve is configured to close the leakage hole upon receipt of the first leakage control signal and open the leakage hole upon receipt of the second leakage control signal.

20 Claims, 6 Drawing Sheets

(56) References Cited

U.S. PATENT DOCUMENTS

| | | | | |
|---|---|---|---|---|
| 2004/0136540 | A1* | 7/2004 | Iwasaki et al. | 381/59 |
| 2004/0156523 | A1* | 8/2004 | Tuason et al. | 381/386 |
| 2007/0154050 | A1* | 7/2007 | Kim | 381/382 |
| 2007/0274531 | A1 | 11/2007 | Camp | |
| 2007/0297634 | A1* | 12/2007 | Hansson | 381/384 |
| 2008/0095393 | A1 | 4/2008 | Klein et al. | |
| 2008/0205666 | A1* | 8/2008 | Tanghe | 381/98 |
| 2009/0028356 | A1* | 1/2009 | Ambrose et al. | 381/71.6 |
| 2010/0061580 | A1 | 3/2010 | Tiscareno et al. | |
| 2010/0111340 | A1* | 5/2010 | Miller et al. | 381/322 |
| 2010/0128905 | A1* | 5/2010 | Warren et al. | 381/312 |
| 2010/0189269 | A1 | 7/2010 | Haartsen et al. | |
| 2010/0329475 | A1* | 12/2010 | Killion et al. | 381/72 |
| 2011/0129108 | A1* | 6/2011 | Miller et al. | 381/322 |

* cited by examiner

IN-EAR HEADPHONE

TECHNICAL FIELD OF THE INVENTION

The invention relates generally to outputting audio from a device via one or more headphones, more particularly, to improving the low frequency performance of such headphones.

DESCRIPTION OF RELATED ART

Headphones or earphones provide a convenient audio interface for a variety of electronic devices, including cellular telephones, portable music players, portable multimedia players, etc. Of particular interest to consumers are high performance headsets that are small, lightweight, and reliable. Earbud or in-ear style earphones represent one type of headphone that meets all of these requirements.

In-ear style earphones typically include a sound output tube that projects into a user's ear canal and a resilient tip around the tube that conforms to the user's ear canal and provides a seal between the earphones and the user's ear. Sealed earphones may cause a high pressure condition within the ear canal and may cause unintended discomfort when inserting or removing the earphones. To remedy this discomfort, many in-ear style earphones include small leakage holes or vents for allowing pressure release from within the ear canal of the user. Unfortunately, the loss of pressure can result in decreased low-frequency performance.

SUMMARY

In one implementation, a method for outputting audio to a headphone device having a leakage hole may include analyzing audio that is output by a first device to the headphone device; determining whether the audio includes at least a predetermined level of audio having a frequency in a first range of frequencies; closing the leakage hole via a leakage hole valve when it is determined that the audio includes at least the predetermined level of low frequency audio; and opening the leakage hole via the leakage hole valve when it is determined that the audio does not include at least the predetermined level of low frequency audio.

In addition, the first range of frequencies may include frequencies ranging from about 0.0 hertz (Hz) to about 300 Hz.

In addition, the first range of frequencies may include bass frequencies.

In addition, analyzing audio that is output by a first device to the headphone device may include performing real-time audio spectrum analysis on the audio.

In addition, the method may include transmitting a leakage control signal to the leakage control valve, wherein the leakage control signal instructs the leakage control valve to close the leakage hole when it is determined that the audio includes at least the predetermined level of low frequency audio, and wherein the leakage control signal instructs the leakage control valve to open the leakage hole when it is determined that the audio does not include at least the predetermined level of low frequency audio.

In addition, the leakage control valve may include an electrostrictive or electromagnetic material.

In addition, the leakage control signal may include a signal having a voltage to cause the electrostrictive or electromagnetic material to occlude the leakage hole when it is determined that the audio includes at least a predetermined level of low frequency audio.

In addition, the leakage hole may have a diameter of between 0.1 and 1.0 millimeters.

In addition, the method may include determining whether the headphone device is being worn by a user; and closing the leakage hole via the leakage hole valve when it is determined that the audio includes at least the predetermined level of low frequency audio and that the headphone device is being worn by a user.

In addition, determining whether the headphone device is being work by a user may include monitoring a sensor to determine whether the headphone device is being worn by a user.

In another implementation, a headphone device may include a housing including a leakage hole to reduce pressure between a user's ear and the housing; a leakage hole valve positioned in the leakage hole; a speaker positioned within the housing; and an audio processing module, wherein the audio processing module may be configured to: receive an audio signal from an audio device; determine whether the audio signal includes at least a predetermined level of audio having a frequency in a first range of frequencies; transmit a first leakage control signal to the leakage hole valve when it is determined that the audio includes at least the predetermined level of low frequency audio; and transmit a second leakage control signal to the leakage hole valve when it is determined that the audio does not include at least the predetermined level of low frequency audio, and wherein the leakage hole valve is configured to: close the leakage hole upon receipt of the first leakage control signal; and open the leakage hole upon receipt of the second leakage control signal.

In addition, the headphone device may further include a wired interface for receiving the audio signal from the audio device.

In addition, the headphone device may further include a wireless interface for receiving the audio signal from the audio device.

In addition, the first range of frequencies comprises frequencies may range from about 0.0 hertz (Hz) to about 300 Hz.

In addition, the audio processing module may be configured to perform real-time audio spectrum analysis on the audio; and determine whether the audio signal includes at least a predetermined level of audio having a frequency in a first range of frequencies based on the real-time audio spectrum analysis.

In addition, the leakage control valve may include an electrostrictive material.

In addition, the first leakage control signal may include a signal having a voltage to cause the electrostrictive material to occlude the leakage hole when it is determined that the audio includes at least the predetermined level of low frequency audio.

In addition, the second leakage control signal may include a signal having a voltage to cause the electrostrictive material to open the leakage hole when it is determined that the audio does not include at least the predetermined level of low frequency audio.

In yet another implementation, a computer-readable memory device having stored thereon sequences of instructions which, when executed by at least one processor, cause the at least one processor to perform audio spectrum analysis associated with audio signals output by a device; determine whether the audio includes at least a predetermined level of audio having a frequency in a first range of frequencies based on the audio spectrum analysis; close a leakage hole in a headphone housing via a leakage hole valve when it is determined that the audio includes at least a predetermined level of low frequency audio; and open the leakage hole via the leakage hole valve when it is determined that the audio does not include at least the predetermined level of low frequency audio.

In addition, the computer-readable memory device may further include instructions to transmit a first leakage control signal to the leakage hole valve when it is determined that the audio includes at least the predetermined level of low frequency audio; and transmit a second leakage control signal to the leakage hole valve when it is determined that the audio does not include at least the predetermined level of low frequency audio.

BRIEF DESCRIPTION OF THE DRAWINGS

The accompanying drawings, which are incorporated in and constitute part of this specification, illustrate one or more embodiments described herein and, together with the description, explain the embodiments. In the drawings.

DETAILED DESCRIPTION

The following detailed description refers to the accompanying drawings. The same reference numbers in different drawings may identify the same or similar elements. The same reference numbers in different drawings identify the same or similar elements. Also, the following detailed description does not limit the invention. Instead, the scope of the invention is defined by the appended claims and equivalents.

As described briefly above, earphones or headphones may be provided with a small aperture or hole for allowing pressure resulting from sound production in an enclosed ear canal of a user to be reduced or equalized. In some instances, this hole is referred to as a "leakage hole" by virtue of the hole allowing air and pressure to "leak" from the ear canal of the user. Providing a leakage hole allows, among other effects, for the headphones to be comfortably inserted and withdrawn from the ear canals without a significant change in pressure in the user's ear canals. As described, conventional leakage hole configurations typically trade off the comfort and normalization of users with some reduction in low frequency response (e.g., bass).

Consistent with embodiments described herein, a leakage hole may be dynamically opened and closed in response to a number of control signals or sensed parameters, thereby providing for both increased low frequency response as well as increased user comfort upon insertion or removal of the headphones by the user. Exemplary control signals may be based on a frequency analysis (e.g., an audio spectrum analysis) of sound being output from the headphones. In other embodiments, the leakage hole control signal may be based on other sensors, such as a pressure sensor, an earphone insertion sensor, etc.

Figure 1B:
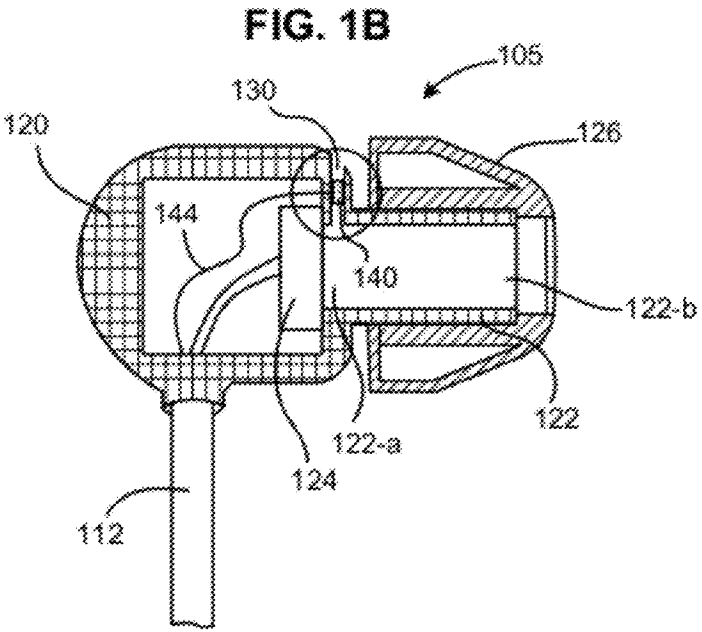
FIGS. 1A, 1B, 1C, and 1D illustrate exemplary headphones consistent with embodiments described herein.
Figure 1D:
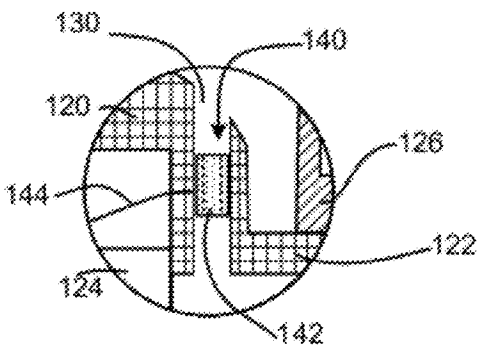
Figure 1A:
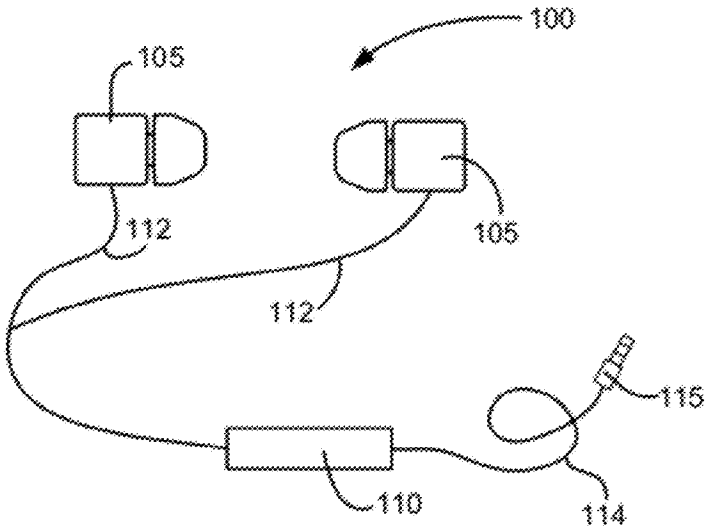
Figure 1C:
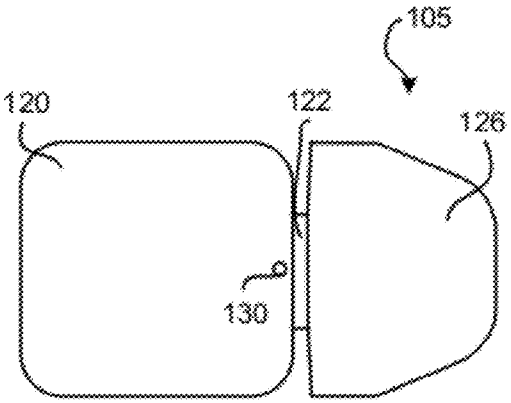

FIGS. 1A-1D illustrate exemplary headphones consistent with embodiments described herein. More specifically, FIG. 1A shows an overview of a pair 100 of in-ear style headphones 105 (sometimes referred to as "earbuds"). FIG. 1B is a cross-sectional view of headphone 105 consistent with embodiments described herein. FIG. 1C is a top plan view of headphone 105. FIG. 1D is an enlarged portion of the cross-sectional view of FIG. 1B.

As shown in FIG. 1A, headphones 100 may be wired headphones and may be coupled to an audio processing module 110 via wires 112 and further coupled to an input/output jack 115 via wire 114. Audio signals may be received from a user device (an exemplary user device is depicted in FIG. 2 and described in detail below) via input/output jack 115 and processed by audio processing module 110. In some implementations, audio processing logic may include volume control logic, noise canceling logic, amplification logic, etc. Furthermore, in some implementations, audio processing logic may be integrated within one or both of headphones 105. As described below, audio processing logic may be further configured to dynamically engage or disengage leakage holes 130 (e.g., FIG. 1B) in headphones 105 based on received audio signals or other parameters.

As shown in FIG. 1B, each of headphones 105 may include a housing 120, a sound output tube 122, a speaker 124, resilient tip 126, a leakage hole 130, and leakage hole valve 140. Housing 120 may include a substantially cylindrical, rigid configuration configured to receive wire 112. Housing 120 may be further sized to support speaker 124 at one end 122-*a* of sound output tube 122, with speaker 124 being operatively coupled to wire 112. Speaker 124 may be configured to receive audio signals via wire 112 and output sound corresponding to the audio signals to end 122-*a* of sound output tube 122. The other end 122-*b* of sound output tube 122 may be configured to extend within an ear canal of a user (not shown) to direct the sound output by speaker 124 into the ear canal of the user.

Resilient tip 126 is mounted on or otherwise coupled to end 122-*b* of sound output tube 122 and is configured to flexibly engage the ear canal of the user, to provide a substantially air-tight fit between headphones 105 and the user's ear canal. The fitment of resilient tip 126 within a user's ear canal provides a desired level of audio performance and additionally reduces the likelihood that the headphones 105 will unintentionally fall out of the user's ears. In some embodiments, resilient tips 126 may be interchangeable and may come in a number of sizes to accommodate different sized ear canals.

Consistent with embodiments described herein, leakage hole 130 (also referred to as pressure equalization hole 130 or vent 130) may be provided in a portion of housing 120 adjacent or in proximity to sound output tube 122 and may permit air and pressure to flow between sound output tube 122 and the outside environment. Although shown schematically at a particular location relative to housing 120 and sound outlet tube 122, in practice leakage hole 130 may be provided in any configuration that enables exhausting or release of air pressure from within sound output tube 122. Leakage hole 130 may have an outside diameter ranging from approximately 0.1 to 1.0 mm depending on configuration and a power of speaker 124.

Consistent with embodiments described herein, leakage hole valve 140 may be configured to provide controllable occlusion of leakage hole 130 based on parameters associated with headphones 105. For example, in one implementation shown in FIG. 1D, leakage hole valve 140 may include a tube 142 or other occluding element formed of an electrostrictive material coupled to a wire 144. The term "electrostrictive material" refers to any material that deforms or changes size/shape upon application of an electric field, e.g., through application of a voltage thereto. Examples include piezoelectric materials, electrostrictive ceramics, electrostrictive polymers, electromagnetic valves, etc.

As depicted in FIG. 1B, in one embodiment, wire 144 may be coupled to audio processing module 110 and may receive a leakage control signal based on audio signals processed by audio processing module 110. For example, the leakage control signal may be based on a frequency of an output audio signal. In such an implementation, the leakage control signal may include a first voltage for output audio signals having a first range of frequencies and a second voltage for output audio signals having a first range of frequencies. Although depicted as wired headphones 100 in FIGS. 1A-1D, in some embodiments, headphones 100 may communicate with a user device via a wireless interface, such as a Bluetooth® interface. In such an implementation, audio signals (and/or control signals) may be transmitted to/from headphones via an antenna integrated within housing 120. Additional details relating to the leakage control signal are set forth below with respect to FIG. 3.

Physical properties of leakage hole valve 140 may be affected based on the leakage control signal. For example, a leakage control signal having the first voltage may cause leakage hole valve 140 to exhibit an initial or unstained configuration which does not fully occlude or close off leakage hole 130, thereby allowing pressure to exhaust from sound output tube 122. However, when the leakage control signal includes the second voltage, leakage hole valve 140 may deform or strain in such a manner as to substantially fully occlude leakage hole 130, thereby retaining pressure within sound output tube 122 and improving a frequency response of speaker 124.

In another exemplary implementation, leakage hole valve 140 may respond to pressure variations within housing 120 or sound output tube 122. For example, audio processing module 110 may be configured to monitor pressure levels or acoustic impedance of speaker 124. Depending on the environment in which speaker 124 is operating (e.g., in-ear or outside of the ear), variations in sound pressure at speaker 124 may be determined to determine, for example, whether the headphones 105 are positioned in a user's ears.

Consistent with this implementation, audio processing module 110 may be configured to determine when headphones 105 are positioned within a user's ears based on the monitored sound pressure or acoustic impedance of speaker 124. The output of the leakage control signal may then be based on this determination.

Although described in relation to FIGS. 1B and 1D as including an electrostrictive element, in other implementations, leakage hole valve 140 may include other configurations, such as a mechanical valve, a mechanical cover, etc.

In different implementations, headphones 105 may include additional, fewer, or different components than the ones illustrated in FIGS. 1A-1D. For example, headphones 105 may include one or more network interfaces, such as interfaces for receiving and sending information from/to other devices, one or more processors, etc.

Figures 2A, 2B:
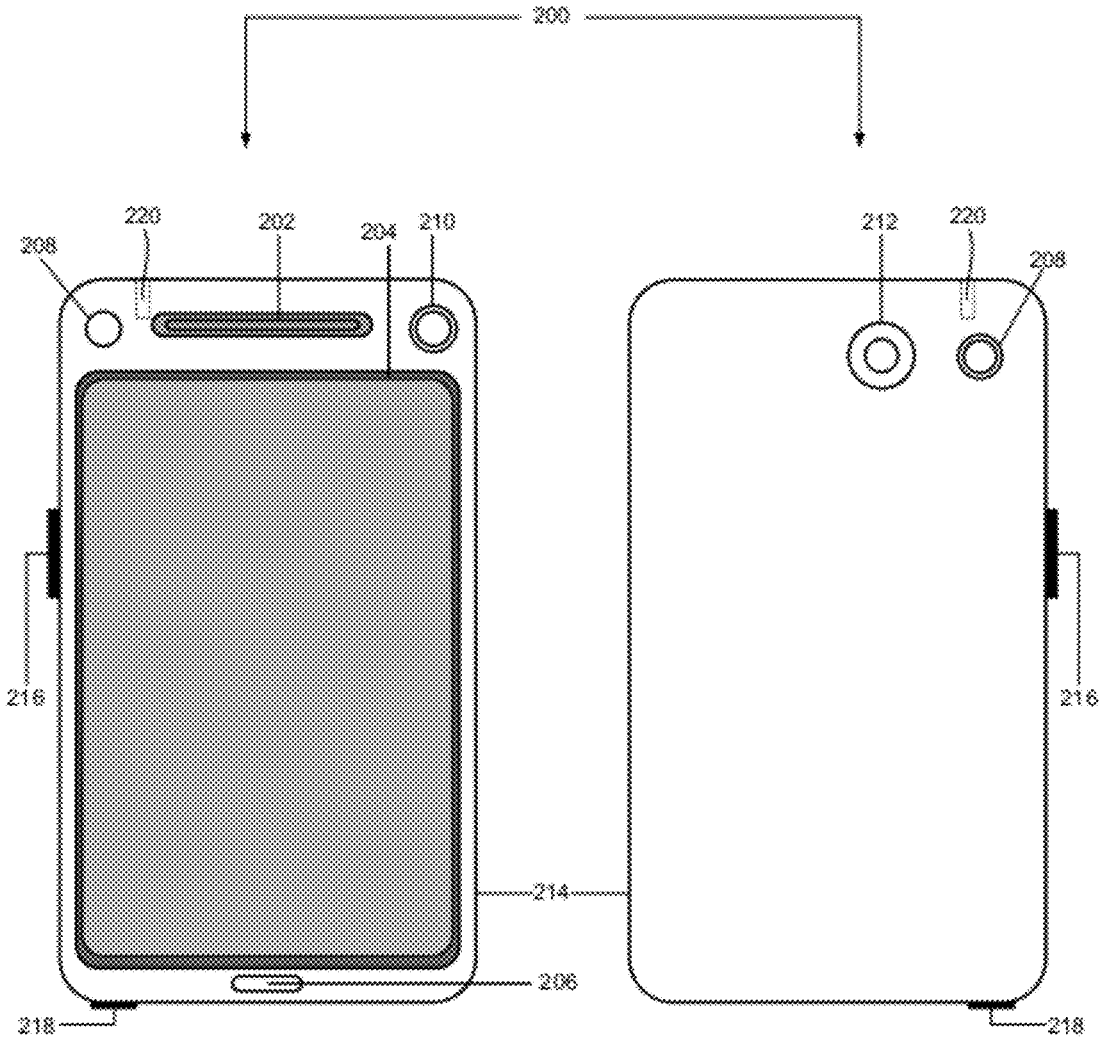
FIGS. 2A and 2B are front and rear views of an exemplary user device of FIG. 2.

FIGS. 2A and 2B are front and rear views, respectively, of a user device 200 in which methods and systems described herein may be implemented. In this implementation, user device 204 may take the form of a cellular or mobile telephone. As shown in FIGS. 2A and 2B, user device 200 may include a speaker 202, display 204, microphone 206, sensors 208, front camera 210, rear camera 212, housing 214, volume control button 216, power port 218, and speaker jack 220. Depending on the implementation, user device 200 may include additional, fewer, different, or different arrangement of components than those illustrated in FIGS. 2A and 2B.

Speaker 202 may provide audible information to a user of user device 200, such as music, ringtones, alerts, etc. Display 204 may provide visual information to the user, such as an image of a caller, video images received via cameras 210/212 or a remote device, etc. In addition, display 204 may include a touch screen via which user device 204 receives user input. The touch screen may receive multi-touch input or single touch input.

Microphone 206 may receive audible information from the user and/or the surroundings. Sensors 208 may collect and provide, to user device 204, information (e.g., acoustic, infrared, etc.) that is used to aid the user in capturing images or to provide other types of information (e.g., a distance between user device 204 and a physical object).

Front camera 210 and rear camera 212 may enable a user to view, capture, store, and process images of a subject in/at front/back of user device 204. Front camera 210 may be separate from rear camera 212 that is located on the back of user device 204. Housing 214 may provide a casing for components of user device 204 and may protect the components from outside elements.

Volume control button 216 may permit user 102 to increase or decrease speaker volume. Power port 218 may allow power to be received by user device 204, either from an adapter (e.g., an alternating current (AC) to direct current (DC) converter) or from another device (e.g., computer). Speaker jack 220 may include a plug into which one may attach speaker wires (e.g., headphone wire 114 via input/output jack 115 in FIG. 1A), so that electric signals from user device 200 can drive the speakers (e.g., headphones 100), to which the speaker wires run from speaker jack 220.

Figure 3:
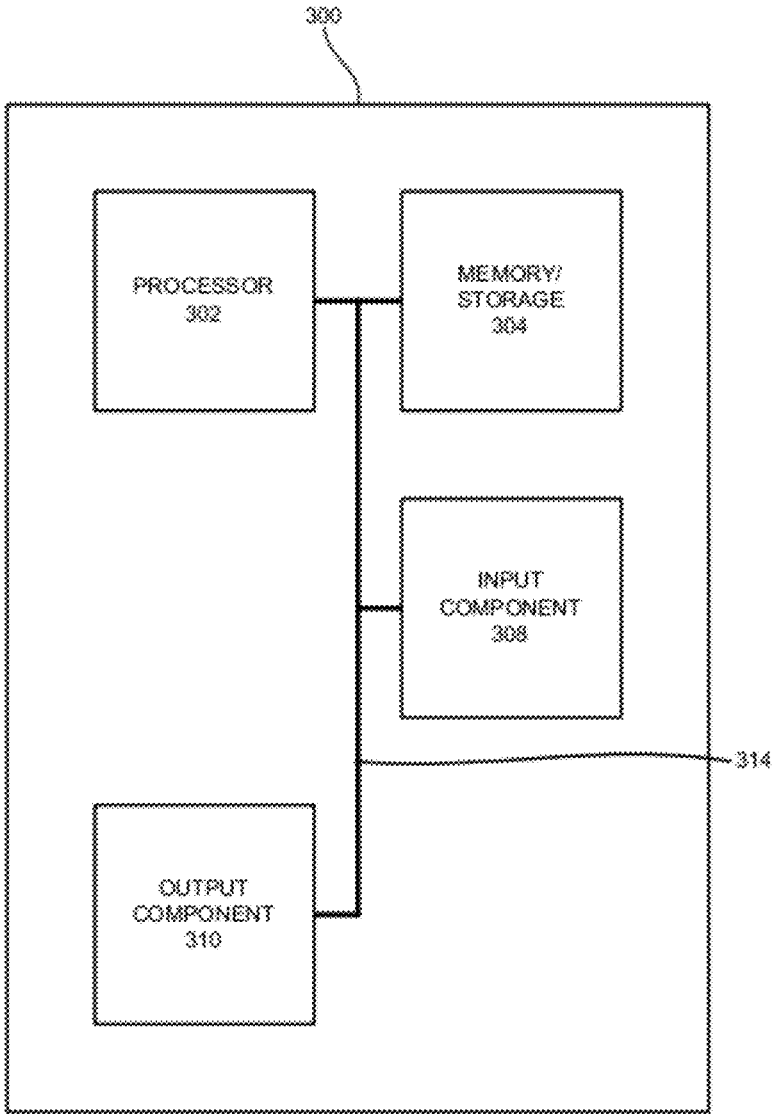
FIG. 3 is a block diagram of exemplary components of a device of FIGS. 1A-2B.

FIG. 3 is a block diagram of exemplary components of device 300. Device 300 may represent any one of headphones 105, audio processing module 110, and/or user device 200. As shown in FIG. 3, device 300 may include a processor 302, memory 304, storage unit 306, input component 308, output component 310, and communication path 314.

Processor 302 may include a processor, a microprocessor, an Application Specific Integrated Circuit (ASIC), a Field Programmable Gate Array (FPGA), and/or other processing logic (e.g., audio/video processor) capable of processing information and/or controlling device 300.

Memory/storage 304 may include static memory, such as read only memory (ROM), and/or dynamic memory, such as random access memory (RAM), or onboard cache, for storing data and machine-readable instructions. Memory/storage unit 304 may also include storage devices, such as a floppy disk, CD ROM, CD read/write (R/W) disc, hard disk drive (HDD), flash memory, as well as other types of storage devices.

Input component 308 and output component 310 may include a display screen, a keyboard, a mouse, a speaker, a microphone, a Digital Video Disk (DVD) writer, a DVD reader, Universal Serial Bus (USB) port, and/or other types of components for converting physical events or phenomena to and/or from digital signals that pertain to device 300.

Communication path 414 may provide an interface through which components of network device 400 can communicate with one another.

Figure 4:
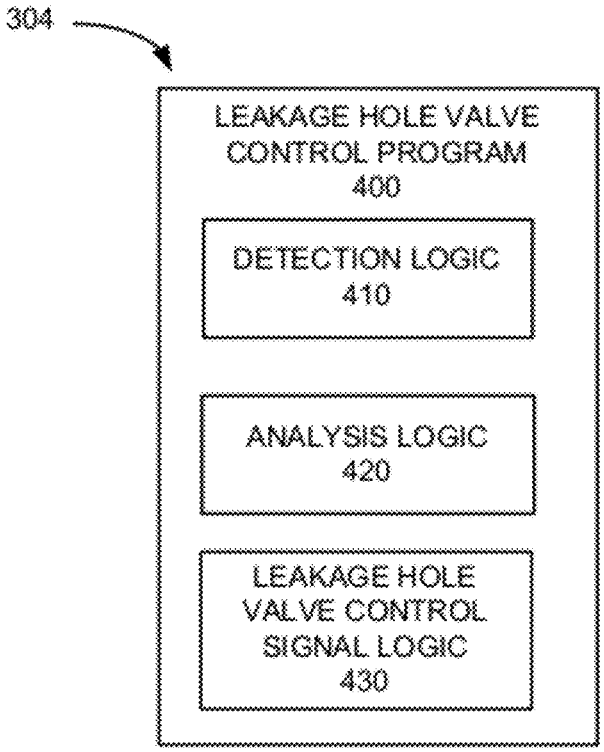
FIG. 4 is a functional block diagram the device of FIG. 3.

In different implementations, device 300 may include additional, fewer, or different components than the ones illustrated in FIG. 4. For example, device 300 may include one or more network interfaces, such as interfaces for receiving and sending information from/to other devices.

FIG. 4 is a block diagram of exemplary functional components of device 300. The components illustrated in FIG. 4 may be included in a single device/module, such as audio processing module 110 (which may be integrated in whole, or in part in headphones 105) or user device 200. For example, some of the components illustrated in FIG. 4 may be stored in memory/storage 404 and may be executed by processor 402 to control leakage hole valve 140 in the manner briefly described above. For example, memory/storage 304 may store a leakage hole valve control program 400 executed by processor 220 that controls the opening/closing of leakage hole valve 140.

Referring to FIG. 4, leakage hole valve control program 300 stored in memory 404 may include detection logic 410, analysis logic 420 and leakage hole valve control signal logic 430. Detection logic 410 may be configured to detect the occurrence of one or more different types of events. For example, detection logic 410 may be configured to determine that audio signals are being directed from user device 200 to headphones 105, such as via wire 114 or a wireless interface (not shown). Exemplary audio signals may include telephone call audio, music, alerts, ringtones, etc.

In addition, detection logic 410 may determine one or more other parameters, such as in-ear sensors configured to determine whether headphones 105 are positioned within the user's ears. For example, headphones 105 may include a mechanism for monitoring sound pressure levels (SPLs) to determine whether headphones 105 are positioned within the ear canals of the user.

Regardless of the source or type of event that is detected, detection logic 410 may forward information regarding a detected event to analysis logic 420 as a trigger for processing performed by analysis logic 420.

Analysis logic 420, after being notified of an event, may perform analysis associated with the event. For example, analysis logic 420 may be notified that user device 200 is outputting music to headphones 105 and that headphones 105 are positioned within the ear canals of the user.

In response to this information, analysis logic 420 may perform audio spectrum or frequency analysis of audio that is output by device 200 (e.g., music or a song associated with an alarm, a ringtone associated with a received telephone call, an audio portion of a video or multi-media file being executed or played by user device 200, etc.). For example, analysis logic 420 may perform real-time audio spectrum analysis of music or ringtones output by user device 200. In one implementation, analysis logic 420 may identify one frequency band associated with low frequencies (e.g., bass tones), and another frequency band associated with high frequencies (e.g., treble tones).

Figure 5:
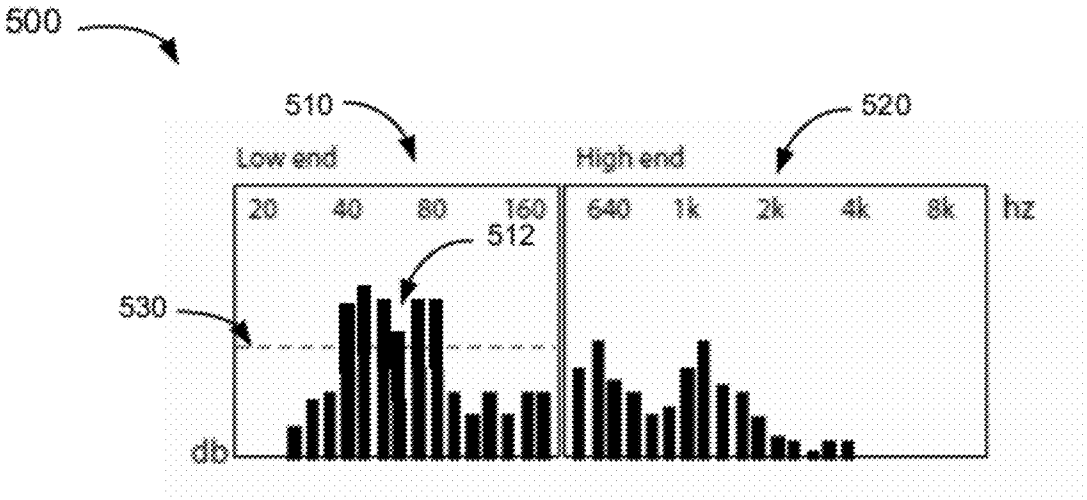
FIG. 5 is an exemplary diagram associated with performing audio spectrum analysis of signals output by the device of FIG. 2.

For example, FIG. 5 illustrates an exemplary audio spectrum 500 associated with output from user device 200. Referring to FIG. 5, in an exemplary implementation, analysis logic 420 may divide the frequency/audio spectrum into a low frequency band of frequencies, labeled 510 in FIG. 5, and a high frequency band of frequencies, labeled 520 in FIG. 5. In one implementation, low frequency band 510 may range from 0 hertz (Hz) to about 300 Hz, and high frequency band 520 may range from 300 Hz to 8000 Hz and above.

Analysis logic 420 may be further configured to determine whether a trigger or threshold value corresponding to a particular decibel (dB) value for a particular range of frequencies (e.g., bass range frequencies) associated with the audio output has been exceeded. For example, FIG. 5 further illustrates a predetermined dB value labeled 530. The particular dB value for trigger/threshold value 530 may be set to correspond to portions of the audio that are more prominent than other portions, based on the dB output level. When analysis logic 420 detects that one or more of the frequencies in low end band 510 achieves or exceeds trigger value 530, analysis logic 320 may forward an indicator signal to leakage hole valve control signal logic 430. In other words, analysis logic 420 may determine when a prevailing or prominent portion of an output audio signal is in the bass range and when the prevailing or prominent portion of an output audio signal is not in the bass range. Leakage hole valve control signal logic 430 may then send a signal corresponding to this determination to leakage hole valve 140 in headphones 105.

In other implementations, analysis logic 420 may generate the indicator signal to leakage hole valve control signal logic 430 based on different or additional determinations. For example, analysis logic 430 may additionally determine whether headphones 105 are positioned within the ear canals of a user and may transmit the indicator signal to leakage hole valve control signal logic 430 when it is determined that headphones 105 are positioned in the user's ears. This prevents unnecessary use of power to drive the leakage control signal control when the headphones are not inserted. Such determination may be made via in-ear pressure sensors, etc. In some embodiments, analysis logic 430 may base the indicator signal to leakage hole valve control signal logic 430 alone, without performing audio spectrum analysis. In such an embodiment, opening or closing of leakage hole 130 may be based solely or primarily on a position of headphones 105.

Leakage hole valve control signal logic 430 may receive information generated by analysis logic 420 regarding, for example, a bass level in an audio signal that is output by user device 100. In response, leakage hole valve control signal logic 430 may output a leakage control signal to leakage control valve 140. For example, leakage control signal may include a signal having a voltage necessary to effect opening/closing of leakage hole valve 140. More specifically, when an initial state of leakage control valve 140 is in an unoccluded (e.g., open) configuration, the leakage control signal, upon determination of a bass level exceed the predetermined trigger/threshold value (e.g., value 530) may include a voltage component sufficient to transform the leakage hole valve 140 into a second, occluded configuration. For electrostrictive or piezo materials, the voltage component may be sufficient cause the material to deform to an extent sufficient to cause occlusion of leakage hole 130.

In a wired implementation, as shown in FIG. 1A-1D, audio processing module 110 may output the leakage control signal on wire 144. In other implementations, one or more components of leakage hole valve control program 400 may be integrated within headphones 105, e.g., via a printed circuit board (PCB) positioned within housing 120. In other implementations, the audio signal may be transmitted to headphones 105 via a wireless signal, such as via a Bluetooth® audio signal.

Depending on the implementation, device 300 may include additional, fewer, different, or a different arrangement of functional components than those illustrated in FIG. 4. For example, device 300 may include an operating system, applications, device drivers, graphical user interface components, communication software, digital sound processor (DSP) components, etc. In another example, depending on the implementation, leakage hole valve control program 400 may be part of a program or an application, such as a game, document editor/generator, utility program, multimedia program, video player, music player, or another type of application.

Figure 6:
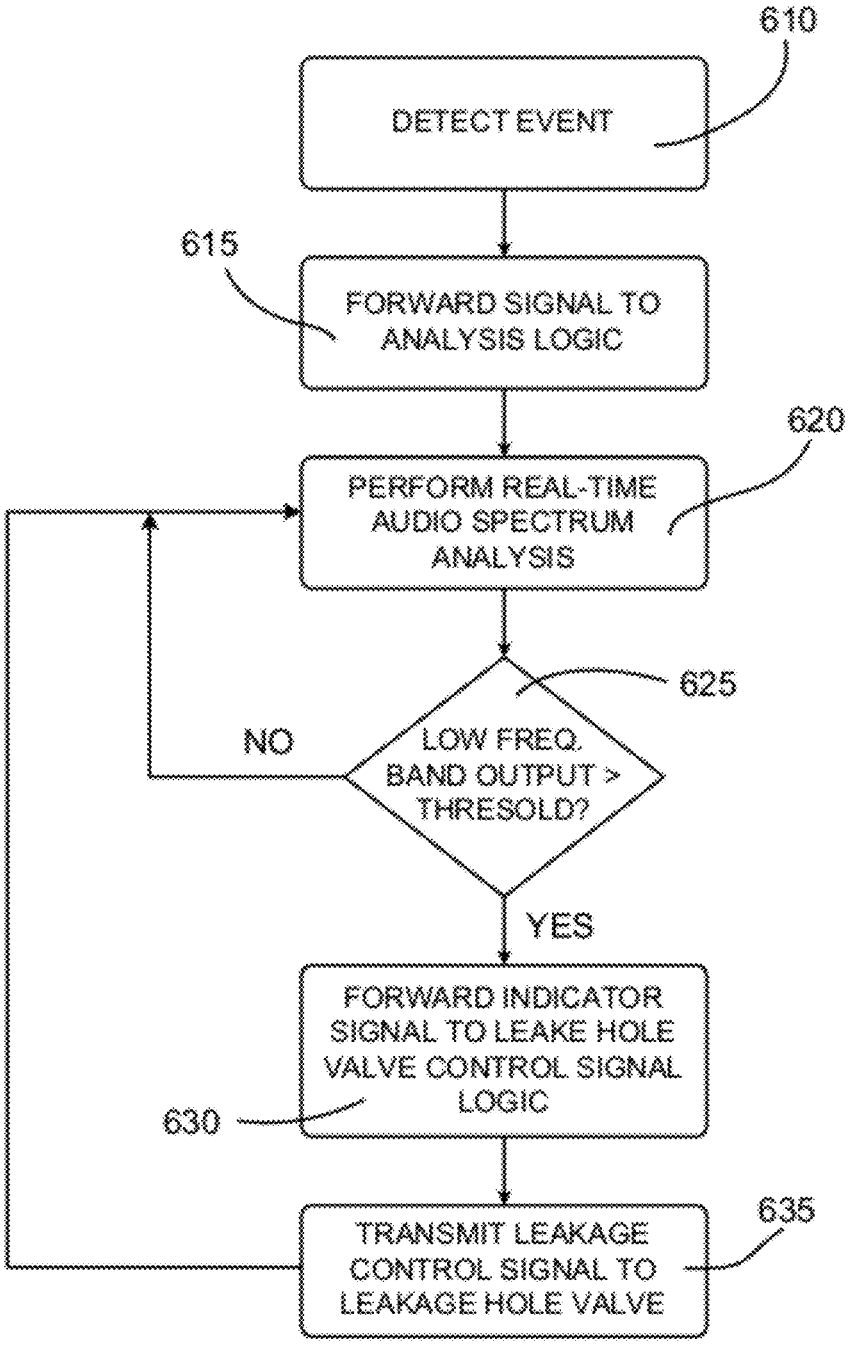
FIG. 6 is a flow diagram of exemplary processing associated with controlling the opening/closing of a leakage hole valve in a manner consistent with implementations described herein.

FIG. 6 illustrates exemplary processing associated with controlling the opening/closing of a leakage hole valve 140 in a manner consistent with implementations described herein. Processing may begin with device 300 detecting an event (block 610). For example, detection logic 410 may detect a real-time event, such as the outputting of music, a ringtone, any other audio signal, etc.

In this example, assume that a user has activated a music player associated with user device 200 (e.g., the event is the music player outputting an audio signal). In this case, user device 200 may output selected music. Detection logic 410 may detect that music is being output to headphones 105 and may forward a signal to analysis logic 420 indicating that the event has occurred (block 615).

Analysis logic 420 may begin performing analysis of the audio output associated with the determined event (block 620). For example, analysis logic 420 may determine whether an output in a low frequency band meets or exceeds a predetermined threshold level (block 625). For example, referring to FIG. 5, analysis logic 420 may determine whether the decibel level at any one of the frequencies in low frequency range 510 meets or exceeds threshold level 530. In other implementations, analysis logic 420 may monitor a sound level or acoustic impedance of speaker 124 to determine a position of headphones 105 relative to a user's ears.

If the audio output associated with the output audio signal does not include an output at any of the frequencies in the audio spectrum that meet the threshold level 530 (block 625—NO), processing returns to block 620 with monitoring the audio spectrum of the alarm in substantially real-time (e.g., for a next sampling interval). If, however, analysis logic 420 identifies that the output audio signal exceeds target/threshold level 530 in low frequency range 510 (block 625—YES), analysis logic 420 forwards an indicator signal to leakage hole valve control signal logic 430 (block 630).

In response to the indicator signal, leakage hole valve control signal logic 430 may output a leakage control signal to leakage control valve 140 (block 635). For example, the leakage control signal may include a signal having a voltage necessary to effect opening/closing of leakage hole valve 140. More specifically, when an initial state of leakage control valve 140 is in an open configuration, the leakage control signal, upon determination of a bass level exceed the predetermined trigger/threshold value (e.g., value 530) may include a voltage component sufficient to transform the leakage hole valve 140 into a second, closed configuration. For electrostrictive or piezo materials, the voltage component may be sufficient cause the material to deform to an extent sufficient to cause occlusion of leakage hole 130. For mechanical valve or actuator implementations, the leakage control signal may include a digital signal for activating/instructing the opening/closing of the valve or actuator.

In some implementations, the leakage control signal may include a first signal output when analysis logic 420 determines that the audio signal includes a threshold level of low frequency audio and a second signal output when analysis logic 420 determines that the audio signal does not include a threshold level of low frequency audio.

Such processing may increase the performance of headphones 105 during low frequency output, such as high bass level music, by preventing leakage and loss of pressure that causes reduced fidelity. When audio output includes non-low frequency audio (such as when no music is playing or when other types of audio content are being output (e.g., telephone audio, etc.), leakage hole valve 140 may stay or transition into the initial unoccluded state, thereby providing for comfortable insertion and removal of headphones 105 into the user's ear canal.

As described above, a system may dynamically open or close leakage holes provided in audio headphones to provide both comfortable wearing, insertion and removal and to further enhance low frequency response during use.

The foregoing description of implementations provides illustration, but is not intended to be exhaustive or to limit the implementations to the precise form disclosed. Modifications and variations are possible in light of the above teachings or may be acquired from practice of the teachings.

In the above, while series of blocks have been described with regard to the exemplary processes, the order of the blocks may be modified in other implementations. In addition, non-dependent blocks may represent acts that can be performed in parallel to other blocks. Further, depending on the implementation of functional components, some of the blocks may be omitted from one or more processes.

It will be apparent that aspects described herein may be implemented in many different forms of software, firmware, and hardware in the implementations illustrated in the figures. The actual software code or specialized control hardware used to implement aspects does not limit the invention. Thus, the operation and behavior of the aspects were described without reference to the specific software code—it being understood that software and control hardware can be designed to implement the aspects based on the description herein.

It should be emphasized that the term "comprises/comprising" when used in this specification is taken to specify the presence of stated features, integers, steps or components but does not preclude the presence or addition of one or more other features, integers, steps, components, or groups thereof.

Further, certain portions of the implementations have been described as "logic" that performs one or more functions. This logic may include hardware, such as a processor, a microprocessor, an application specific integrated circuit, or a field programmable gate array, software, or a combination of hardware and software.

No element, act, or instruction used in the present application should be construed as critical or essential to the implementations described herein unless explicitly described as such. Also, as used herein, the article "a" is intended to include one or more items. Further, the phrase "based on" is intended to mean "based, at least in part, on" unless explicitly stated otherwise.

What is claimed is:

1. A method for outputting audio to a headphone device having a leakage hole, comprising:

analyzing audio that is outputted as an electrical signal by a first device to the headphone device, wherein the first device comprises a mobile electronic device;

dividing a frequency spectrum of the audio into a low frequency band and a high frequency band;

identifying one or more portions of the audio where a decibel value for one or more frequencies included in the low frequency band exceeds a predetermined decibel threshold level set for the low frequency band;

closing the leakage hole via a leakage hole valve when the one or more identified portions of the audio having a decibel value that exceeds the predetermined decibel threshold level set for the low frequency band are output to the headphone device; and opening the leakage hole via the leakage hole valve when another portion of the audio is output to the headphone device.

2. The method of claim 1, wherein the low frequency band comprises frequencies ranging from about 0.0 hertz (Hz) to about 300 Hz.

3. The method of claim 1, wherein analyzing audio that is outputted by a first device to the headphone device comprises:

performing real-time audio spectrum analysis on the audio.

4. The method of claim 1, wherein analyzing audio that is outputted by a first device to the headphone device comprises:

performing sound level or acoustic impedance monitoring for a speaker associated with the headphone device.

5. The method of claim 1 further comprising:

transmitting a leakage control signal to the leakage control valve, wherein the leakage control signal instructs the leakage control valve to close the leakage hole when the one or more identified portions of the audio having a decibel value that exceeds the predetermined decibel threshold level set for the low frequency band are output to the headphone device, and wherein the leakage control signal instructs the leakage control valve to open the leakage hole when another portion of the audio is output to the headphone device.

6. The method of claim 5, wherein the leakage control valve comprises an electrostrictive or electromagnetic material.

7. The method of claim 6, wherein the leakage control signal comprises a signal having a voltage to cause the electrostrictive or electromagnetic material to occlude the leakage hole when the one or more identified portions of the audio having a decibel value that exceeds the predetermined decibel threshold level set for the low frequency band are output to the headphone device.

8. The method of claim 1, wherein the leakage hole has a diameter of between 0.1 and 1.0 millimeters.

9. The method of claim 1, further comprising:

determining whether the headphone device is being worn by a user; and closing the leakage hole via the leakage hole valve when the one or more identified portions of the audio having a decibel value that exceeds the predetermined decibel threshold level set for the low frequency band are output to the headphone device and it is determined that the headphone device is being worn by a user.

10. The method of claim 9, wherein determining whether the headphone device is being worn by a user comprises:

monitoring a sensor to determine whether the headphone device is being worn by a user.

11. A headphone device, comprising:

a housing including a leakage hole to reduce pressure between a user's ear and the housing;

a leakage hole valve positioned in the leakage hole;

a speaker positioned within the housing; and an audio processing module, wherein the audio processing module is configured to:

receive audio outputted as an electrical signal from an audio device, wherein the audio device comprises a mobile electronic device;

divide a frequency spectrum of the audio into a low frequency band and a high frequency band;

identify one or more portions of the audio where a decibel value for one or more frequencies included in the low frequency band exceeds a predetermined decibel threshold level set for the low frequency band;

transmit a first leakage control signal to the leakage hole valve when the one or more identified portions of the audio having a decibel value that exceeds the predetermined decibel threshold level set for the low frequency band are output to the headphone device; and transmit a second leakage control signal to the leakage hole valve when another portion of the audio is output to the headphone device, and wherein the leakage hole valve is configured to:

close the leakage hole upon receipt of the first leakage control signal; and open the leakage hole upon receipt of the second leakage control signal.

12. The headphone device of claim 11, further comprising a wired interface for receiving the electrical signal from the audio device.

13. The headphone device of claim 11, further comprising a wireless interface for receiving the electrical signal from the audio device.

14. The headphone device of claim 11, wherein the low frequency band comprises frequencies ranging from about 0.0 hertz (Hz) to about 300 Hz.

15. The headphone device of claim 11, wherein the audio processing module is configured to:

perform real-time audio spectrum analysis on the electrical signal; and identify one or more portions of the audio where a decibel value for one or more frequencies included in the low frequency band exceeds a predetermined decibel threshold level set for the low frequency band based on the real-time audio spectrum analysis.

16. The headphone device of claim 11, wherein the leakage control valve comprises a electrostrictive material.

17. The headphone device of claim 16, wherein the first leakage control signal comprises a signal having a voltage to cause the electrostrictive material to occlude the leakage hole.

18. The headphone device of claim 16, wherein the second leakage control signal comprises a signal having a voltage to cause the electrostrictive material to open the leakage hole.

19. A computer-readable memory device having stored thereon instructions which, when executed by at least one processor, cause the at least one processor to:

perform audio spectrum analysis associated with audio outputted as an electrical signal by a mobile electronic device;

divide a frequency spectrum of the audio into a low frequency band and a high frequency band;

identify one or more portions of the audio where a decibel value for one or more frequencies included in the low frequency band exceeds a predetermined decibel threshold level set for the low frequency band;

close a leakage hole in a headphone device via a leakage hole valve when the one or more identified portions of the audio having a decibel value that exceeds the predetermined decibel threshold level set for the low frequency band are output by the mobile device; and open the leakage hole via the leakage hole valve when another portion of the audio is output to the headphone device.

20. The computer-readable memory device of claim 19, further comprising instructions to:

transmit a first leakage control signal to the leakage hole valve when the one or more identified portions of the audio having a decibel value that exceeds the predetermined decibel threshold level set for the low frequency band are output by the mobile device; and transmit a second leakage control signal to the leakage hole valve when another portion of the audio is output to the headphone device.

* * * * *